US009601249B2

(12) United States Patent
Taniguchi et al.

(10) Patent No.: US 9,601,249 B2
(45) Date of Patent: Mar. 21, 2017

(54) SOFT MAGNETIC METAL POWDER-COMPACT MAGNETIC CORE AND REACTOR

(71) Applicant: TDK CORPORATION, Tokyo (JP)

(72) Inventors: Yusuke Taniguchi, Tokyo (JP); Tomofumi Kuroda, Tokyo (JP); Yu Sakurai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/008,872

(22) Filed: Jan. 28, 2016

(65) Prior Publication Data

US 2016/0225503 A1 Aug. 4, 2016

(30) Foreign Application Priority Data

Feb. 2, 2015 (JP) ..... 2015-018627
Oct. 6, 2015 (JP) ..... 2015-198546

(51) Int. Cl.

| | |
|---|---|
| ***H01F 37/00*** | (2006.01) |
| ***H01F 27/24*** | (2006.01) |
| ***H01F 3/08*** | (2006.01) |
| ***C22C 19/03*** | (2006.01) |
| ***H01F 1/147*** | (2006.01) |
| ***C22C 30/00*** | (2006.01) |
| ***H01F 1/24*** | (2006.01) |
| ***C22C 38/08*** | (2006.01) |
| ***H01F 1/20*** | (2006.01) |
| ***C22C 38/00*** | (2006.01) |

(52) U.S. Cl.

CPC ..... *H01F 3/08* (2013.01); *C22C 19/03* (2013.01); *C22C 30/00* (2013.01); *C22C 38/002* (2013.01); *C22C 38/08* (2013.01); *H01F 1/1475* (2013.01); *H01F 1/14733* (2013.01); *H01F 1/20* (2013.01); *H01F 1/24* (2013.01)

(58) Field of Classification Search

CPC ..... C22C 38/08; C22C 38/002; C22C 19/03; C22C 30/00; H01F 3/08; H01F 1/1475; H01F 1/14733; H01F 1/20; H01F 1/24

See application file for complete search history.

(56) References Cited

U.S. PATENT DOCUMENTS

2011/0272622 A1 11/2011 Wakabayashi et al.
2015/0332821 A1* 11/2015 Sakurai ..... H01F 1/1475 252/62.55
2015/0332823 A1* 11/2015 Sakurai ..... H01F 1/147 75/244
2015/0332824 A1* 11/2015 Sakurai ..... H01F 1/14766 252/62.51 C

FOREIGN PATENT DOCUMENTS

| | | | |
|---|---|---|---|
| EP | 2945172 | * | 11/2015 |
| EP | 2945172 | A1 | 11/2015 |
| JP | 2005-347641 | A | 12/2005 |
| JP | 2009-070885 | A | 4/2009 |
| JP | 2010-236021 | A | 10/2010 |
| JP | 5682723 | B1 | 3/2015 |
| WO | 2010/082486 | A1 | 7/2010 |
| WO | 2014/068928 | A1 | 5/2014 |

OTHER PUBLICATIONS

Jul. 4, 2016 Extended European Search Report issued in European Application No. 16153455.7-1556.

* cited by examiner

*Primary Examiner* — Carol M Koslow
(74) *Attorney, Agent, or Firm* — Oliff PLC

(57) ABSTRACT

The objective is to provide a soft magnetic metal powder-compact magnetic core and a reactor with an excellent DC superposition characteristic. The soft magnetic metal powder-compact magnetic core contains a soft magnetic metal powder, boron nitride and a silicon compound, when its section is ground and then observed, the ratio of the area occupied by the soft magnetic metal powder to that of the section of the soft magnetic metal powder-compact magnetic core is 90% or more and 95% or less, and a roundness of the section of 80% or more of the particles constituting the soft magnetic metal powder is 0.75 or more and 1.0 or less, and boron nitride exists in 70% or more of the voids-among-multiple-particles among the voids-among-multiple-particles in the section of the soft magnetic metal powder-compact magnetic core. Thus, the soft magnetic metal powder-compact magnetic core with an excellent DC superposition characteristic can be obtained.

6 Claims, 7 Drawing Sheets

(A)

(B)

(C)

(A)

(B)

(C)

(A)

(B)

(C)

SOFT MAGNETIC METAL POWDER-COMPACT MAGNETIC CORE AND REACTOR

The present invention relates to a soft magnetic metal powder-compact magnetic core which uses a soft magnetic metal powder.

BACKGROUND

As the electric device and the electronic device are being developed to have a small size, a downsized and highly efficient soft magnetic metal powder-compact magnetic core is required. A ferrite core, a laminated electromagnetic steel plate, a soft magnetic metal powder-compact magnetic core (a core prepared by die molding, injection molding, sheet molding and the like) or the like can be used as the magnetic core material for a reactor or an inductor used for applying a high current. Despite a high saturation magnetic flux density, the laminated electromagnetic steel plate has a problem of increased iron loss when the driving frequency of a power circuit exceeds several tens of kilohertz, resulting in a decreased efficiency. In another respect, the ferrite core is a magnetic core material with a little loss at a high frequency, but problems rise such as a big size due to a low saturation magnetic flux density.

The soft magnetic metal powder-compact magnetic core has been widely used because its iron loss at a high frequency is lower than that of the laminated electromagnetic steel plate and its saturation magnetic flux density is higher than that of the ferrite core. In order to downsize the magnetic core, especially the magnetic permeability needs to be excellent at a high magnetic field where direct current is super positioned. That is, the DC superposition characteristic needs to be excellent. In order to get an excellent DC superposition characteristic, it will be effective to use a soft magnetic metal powder-compact magnetic core having a high saturation magnetic flux density. Further, the soft magnetic metal powder-compact magnetic core needs to have a high density. In addition, improving the homogeneity in the interior of the soft magnetic metal powder-compact magnetic core is also effective in the improvement of the DC superposition characteristic.

Thus, it has been disclosed in Patent Document 1 that the homogeneity in the interior of a molded article can be improved if a reactor core formed by particles with an average particle size of 1 μm or more and 70 μm or less, a coefficient of variation Cv (the ratio of the standard deviation of particle size to the average particle size) of 0.40 or less and a roundness of 0.8 or more and 1.0 or less is used. Further, the DC superposition characteristic can be improved.

In addition, in Patent Document 2, it has been described that boron nitride covers the surface of the soft magnetic metal powder to form a coating that can be deformed to a great extent so as to provide a high density. As a result, effects have been produced such as the improvement of magnetic properties.

PATENT DOCUMENT

Patent Document 1: JP-A-2009-70885
Patent Document 2: JP-A-2010-236021

SUMMARY

In the technique involved in Patent Document 1, the DC superposition characteristic can be improved when the average particle diameter of the soft magnetic metal powder is 1 μm or more and 70 μm or less together with a roundness of 0.8 or more and 1.0 or less and a coefficient of variation Cv (the ratio of the standard deviation of particle diameter to the average particle diameter) of 0.40 or less. However, if the coefficient of variation is to be within the range mentioned above, the curve plotted in terms of particle size distribution has to be very sharp. In this respect, when the soft magnetic metal powder-compact magnetic core is molded, problems will rise that the packing density will decline for sure. As a result, the density of the obtained soft magnetic metal powder-compact magnetic core will decrease, leading to problems such as the deterioration of DC superposition characteristic.

In the technique of Patent Document 2, if a soft magnetic material is used where an insulting layer including boron nitride is covered on the soft magnetic powder, the density will be increased without any damage to the insulating layer. This is because the coating including boron nitride will deform together with the deformation of the soft magnetic metal powder. Thus, even if the density is high, the coating of boron nitride will still exist there to help build the insulation. With the high density, the saturation magnetic flux density increases and the DC superposition characteristic is expected to be improved. However, in fact, when the coating of boron nitride is present among particles, the distance between particles becomes longer, resulting in a decreased magnetic permeability. In this way, a problem comes out that no good DC superposition characteristic will be provided.

As such, problems are there in the prior art. For example, no good DC superposition characteristic will be provided. Therefore, a soft magnetic metal powder-compact magnetic core with an excellent DC superposition characteristic is required The present invention is carried out to solve the problems mentioned above, and the objective is to provide a soft magnetic metal powder-compact magnetic core with an excellent DC superposition characteristic.

In view of the objective above, the soft magnetic metal powder-compact magnetic core of the present invention is characterized in that it is a soft magnetic metal powder-compact magnetic core containing a soft magnetic metal powder, boron nitride and a silicon compound, wherein when a section of the soft magnetic metal powder-compact magnetic core is ground and then observed, the ratio of the area occupied by the soft magnetic metal powder to that of the section of the soft magnetic metal powder-compact magnetic core is 90% or more and 95% or less, and a roundness of the section of 80% or more of the particles constituting the soft magnetic metal powder is 0.75 or more and 1.0 or less, and the boron nitride exists in 70% or more of the voids-among-multiple-particles among the voids-among-multiple-particles existing in the section of the soft magnetic metal powder-compact magnetic core. As such, the soft magnetic metal powder-compact magnetic core has an excellent DC superpositon characteristic. Here, the silicon compound preferably contains silicon (Si), oxygen (O) and carbon (C). More preferably, such a silicon compound is derived from a silicone resin. The silicone resin refers to a resin with its backbone being formed by using the siloxane bond as the structural unit and functional groups such as methyl or phenyl or the like being present in the side chain. The structural unit can be classified into the mono-functional one, the bi-functional one, the tri-functional one and tetra-functional one, and a compound may have them in combination. In addition, the void-among-multiple-particles refers to the void surrounded by three or more soft magnetic metal particles at the section of the soft magnetic metal powder-compact magnetic core, excluding the void surrounded by two particles. When a void is surrounded by four or more soft magnetic metal particles, the closest distance between two particles that are not adjacent but face each other is 1 μm or more in this void.

The soft magnetic metal powder-compact magnetic core of the present invention is characterized in that it is the soft magnetic metal powder-compact magnetic core according to claim 1 or claim 2 and has 0.17 mass % or more and 0.80 mass % or less of boron (B) and 0.22 mass % or more and 1.00 mass % or less of nitrogen (N) relative to the soft magnetic metal powder-compact magnetic core. As such, the DC superposition characteristic can be further improved.

The soft magnetic metal powder-compact magnetic core of the present invention is characterized in that it is the soft magnetic metal powder-compact magnetic core according to claims 1 to 3, wherein, in the particle size distribution of the soft magnetic metal powder, when the particle diameter at which the number cumulated from the small side reaches 50% is defined as d50%, d50% is 30 μm or more and 60 μm or less. As such, the DC superposition characteristic will be further improved.

The soft magnetic metal powder-compact magnetic core of the present invention is characterized in that it is the soft magnetic metal powder-compact magnetic core according to claims 1 to 4, wherein, when a section of the soft magnetic metal powder-compact magnetic core is ground and then observed, a structure exists that a soft magnetic metal particle faces at least one adjacent particle at a region where no boron nitride exists. As such, the DC superposition characteristic can be further improved. Here, the absence of boron nitride means that no boron nitride is detectable within the upper limit of a currently used detector such as an electron probe micro-analyzer (EPMA).

The DC superposition characteristic can be improved in a reactor prepared by using the soft magnetic metal powder-compact magnetic core of the present invention.

According to the present invention, a soft magnetic metal powder-compact magnetic core with an excellent DC superposition characteristic can be provided.

DETAILED DESCRIPTION OF EMBODIMENTS

The soft magnetic metal powder-compact magnetic core of the present invention is characterized in that it is a soft magnetic metal powder-compact magnetic core containing a soft magnetic metal powder, boron nitride and a silicon compound, wherein when a section in the soft magnetic metal powder-compact magnetic core is ground and then observed, the ratio of the area occupied by the soft magnetic metal powder to that of the section of the soft magnetic metal powder-compact magnetic core is 90% or more and 95% or less, and a roundness of the section of 80% or more of the particles constituting the soft magnetic metal powder is 0.75 or more and 1.0 or less, and the boron nitride exists in 70% or more of the voids-among-multiple-particles among the voids-among-multiple-particles existing in the section of the soft magnetic metal powder-compact magnetic core.

Hereinafter, the embodiments of the present invention will be described with reference to the drawings.

Figure 1:
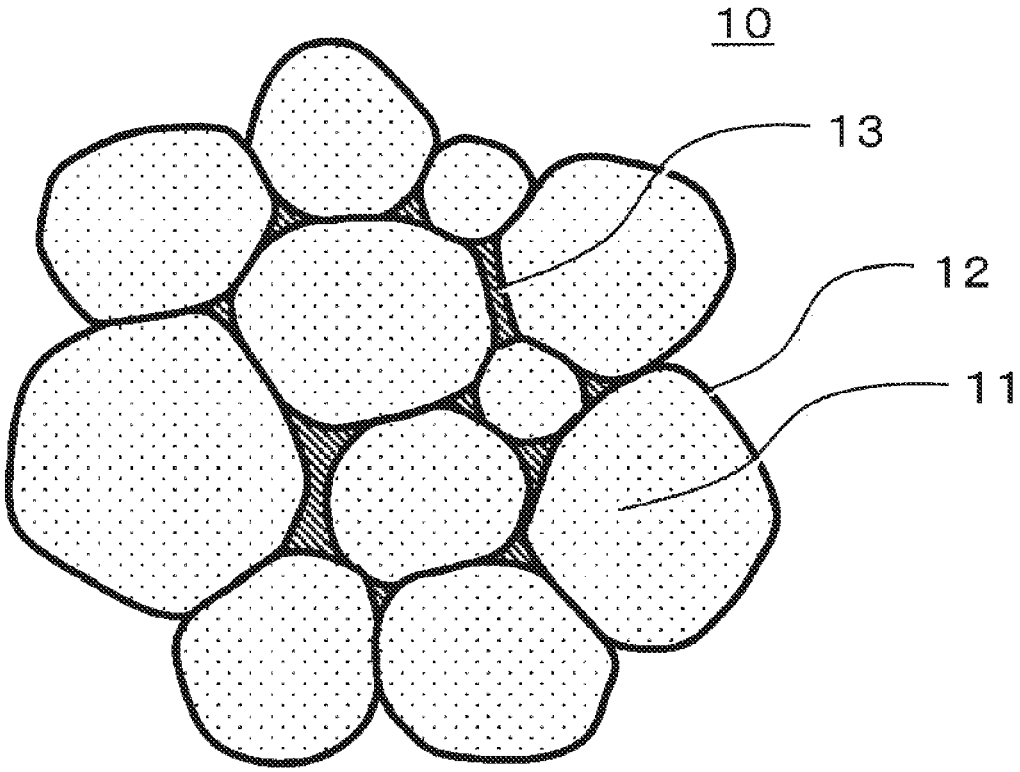
FIG. 1 is a schematic sectional view showing the structure of a soft magnetic metal powder-compact magnetic core in one embodiment of the present invention.

FIG. 1 is a schematic view showing the structure at a section of a soft magnetic metal powder-compact magnetic core 10. The soft magnetic metal powder-compact magnetic core 10 consists of a soft magnetic metal powder 11, a silicon compound 12 covering the surface of most constituent particles, and boron nitride 13 present in the void-among-multiple-particles. The soft magnetic metal powder 11 is a soft magnetic metal having iron as the main component, and can use pure iron, Fe—Si alloy, Fe—Si—Cr alloy, Fe—Al alloy, Fe—Si—Al alloy and Fe—Ni alloy and the like. In order to provide a good DC superposition characteristic, a soft magnetic metal powder with a high saturation magnization is preferably used. Thus, the pure iron, Fe—Si alloy and Fe—Ni alloy are preferably used.

At a section of the soft magnetic metal powder-compact magnetic core 10, the ratio of the area occupied by the soft magnetic metal powder to that of the section of the soft magnetic metal powder-compact magnetic core is calculated. The soft magnetic metal powder occupies 90% or more and 95% or less of the section of the soft magnetic metal powder-compact magnetic core. For the calculation of the ratio of the area occupied by the soft magnetic metal powder to that of the section of the soft magnetic metal powder-compact magnetic core, for example, the compositional image can be observed by using a scanning electron microscope (SEM), and then the calculation is performed by means of image analysis based on the contrast between the metal part and non-metal part. Also, the calculation can be done by means of image analysis on the part occupied by the element Fe in the graph obtained by an electron probe micro-analyzer (EPMA) showing the in-plane element distribution.

When the ratio of the area occupied by the soft magnetic metal powder to that of the section of the soft magnetic metal powder-compact magnetic core is lower than 90% at the section of the soft magnetic metal powder-compact magnetic core 10, the saturation magnetic flux density of the soft magnetic metal powder-compact magnetic core becomes too low, leading to the deterioration of the DC superposition characteristic. On the other hand, as a certain amount of boron nitride or a silicon compound is contained in the soft magnetic metal powder-compact magnetic core, it is hard to have a ratio of the area occupied by the soft magnetic metal powder to that of the section of the soft magnetic metal powder-compact magnetic core that is higher than 95%. In this respect, when the ratio of the area occupied by the soft magnetic metal powder to that of the section of the soft magnetic metal powder-compact magnetic core is 90% or more and 95% or less, the soft magnetic metal powder-compact magnetic core will have a high saturation magnetic flux density and also have its DC superposition characteristic improved.

When the section of the soft magnetic metal powder-compact magnetic core 10 is observed and the roundness of the soft magnetic metal powder 11 is measured, 80% or more of the particles among those of the soft magnetic metal powder 11 have a roundness of 0.75 to 1.0. The roundness defined by Wadell can be used as one example of the roundness. The roundness defined by Wadell is defined as the ratio of the diameter of a circle equal to project area of the section of a particle to the diameter of a circumscribed circle of the section of the particle. If it is a perfect circle, the Wadell roundness will be 1. The closer the roundness gets to 1, the better the circle is. An optical microscope or a SEM can be used in the observation and the image analysis can be used in the roundness calculation.

In a particle having a low roundness, the curvature on the surface of the particle is not constant, so the site where stress is applied during molding will become inhomogeneous. Thus, when a relatively large amount of particles with a low roundness are contained, parts with much plastic deformation are generated together with parts with a little plastic deformation so that the magnetization will not be homogeneous. As a result, the DC superposition characteristic deteriorates. In other words, if 80% or more particles are made to have a roundness of 0.75 to 1.0, a good DC superposition characteristic will be provided. More preferably, 85% or more of the particles have a roundness of 0.75 to 1.0, leading to an even more excellent DC superposition characteristic.

In addition, with the use of a soft magnetic metal powder having a high roundness, an effect will be produced that boron nitride is made to flow during the molding process and boron nitride is concentrated in the void-among-multiple-particles. As described below, with the structure where boron nitride is concentrated in the void-among-multiple-particles, a good DC superposition characteristic will be provided.

As the silicon compound 12 exists among the particles of the soft magnetic metal powder, multiple soft magnetic metal particles are firmly bond and an electrical insulation is provided. In this way, the strength of the soft magnetic metal powder-compact magnetic core can be improved and the eddy current loss can be further decreased.

In addition, the silicone resin is preferably used as the component of the silicon compound. When the silicone resin is used, the silicone resin has an appropriate mobility during the compression molding. Thus, as described below, an effect is promoted that boron nitride can flow during molding and boron nitride is concentrated on the void-among-multiple-particles. With the structure where boron nitride is concentrated in the void-among-multiple-particles, an even better DC superposition characteristic will be provided.

The boron nitride 13 has a structure with hexagonal boron nitride being connected in layers, and the binding force between layers is weak so that these layers are likely to slide from each other. Thus, peeling off is likely to happen when a stress is applied during the compression molding. In this way, boron nitride peels off the surface of the soft magnetic metal powder at the initial stage of the molding process to preferentially fill the void-among-multiple-particles. As boron nitride peels off the surface of the soft magnetic metal particle and declines in amount, the distance between particles may become sufficiently short, resulting in a high magnetic permeability. On the other hand, as boron nitride is filled in the void-among-multiple-particles, the boron nitride filled in the void-among-multiple-particles functions similarly as a wedge so that the soft magnetic metal particles can be prevented from being closely bond together even they are formed in a high density. That is, with the structure where boron nitride is concentrated in the void-among-multiple-particles, a structure can be formed where particles are not closely bond and a uniform and minute distance is kept among particles. Thus, the flowing of the magnetic flux becomes uniform so that a good DC superposition characteristic can be provided.

Figure 2:
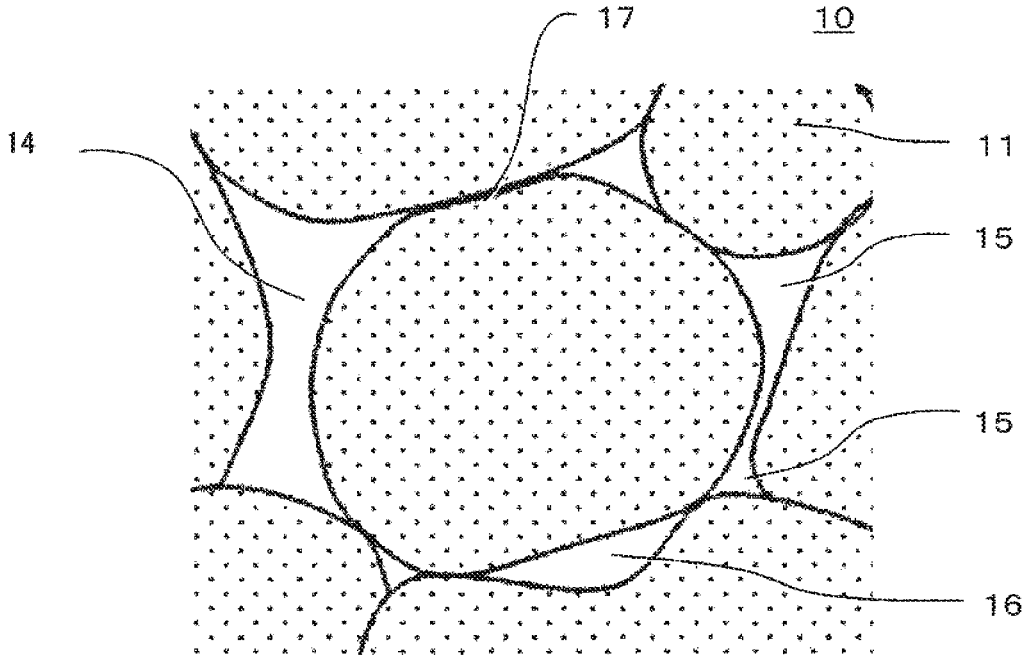
FIG. 2 is a schematic sectional view showing the structure of a soft magnetic metal powder-compact magnetic core in one embodiment of the present invention and is also a view showing the void-among-multiple-particles.

FIG. 2 is a schematic view showing the void-among-multiple-particles at a section of the soft magnetic metal powder-compact magnetic core 10. The void-among-multiple-particles is a void surrounded by three or more soft magnetic metal particles at the section of the soft magnetic metal powder-compact magnetic core, excluding the void between two particles. In addition, the closest distance between particles that are not adjacent but face each other is 1 μm or more in the void 14, and this void can be referred to as a void-among-multiple-particles surrounded by 4 particles. However, the closest distance between particles that are not adjacent but fact each other is shorter than 1 μm in the void 15, so this void can be referred to as a void-among-multiple-particles surrounded by 3 particles but not 4 particles. The void 16 is a void surrounded by 2 particles and thus cannot be referred to as a void-among-multiple-particles. In another respect, the part where the metal particles face each other with the distance between particles being shorter than 1 μm is called the grain boundary 17.

Among the voids-among-multiple-particles present at the section of the soft magnetic metal powder-compact magnetic core, when less than 70% of the voids-among-multiple-particles have boron nitride present therein, the soft magnetic metal powder around the void-among-multiple-particles with no boron nitride will closely bond to each other so that the distance between particles in this part becomes shorter. In this way, the DC superposition characteristic deteriorates. Therefore, as boron nitride is filled in 70% or more of the voids-among-multiple-particles, the distance between particles will be uniformly formed in the whole soft magnetic metal powder-compact magnetic core, and the magnetization will be uniformly performed. As a result, a good DC superposition characteristic can be obtained. Further, if boron nitride is filled in 80% or more of the voids-among-multiple-particles, the distance between particles can be more uniformly formed. Thus, it is preferable that boron nitride is filled in 80% or more of voids-among-multiple-particles.

Preferably, relative to the soft magnetic metal powder-compact magnetic core, 0.17 mass % or more and 0.80 mass % or less of B is contained and 0.22 mass % or more and 1.00 mass % or less of N is contained. If B accounts for 0.17 mass % or more and 0.80 mass % or less and N accounts for 0.22 mass % or more and 1.00 mass % or less, the distance between particles can be more uniformly formed. When the content of B and the content of N are controlled at such ranges, a better DC superposition characteristic can be provided. In addition, relative to the soft magnetic metal powder-compact magnetic core, if 0.26 mass % or more and 0.60 mass % or less of B is contained and 0.34 mass % or more and 0.80 mass % or less of N is contained, an especially good DC superposition characteristic will be provided.

The distribution of boron nitride at the section of the soft magnetic metal powder-compact magnetic core may be learned from the distribution of B and N by using an EPMA. The content of B and N relative to the soft magnetic metal powder-compact magnetic core can be obtained by quantitatively analyzing the content of B and that of N. The content of B can be measured by using an inductively coupled plasma-atomic emission spectrometry (ICP-AES). The content of N can be measured by using a device for analyzing nitrogen content.

The particle size distribution of the soft magnetic metal powder 11 is determined. When the particle diameter at which the number cumulated from the small side reaches 50% is defined as d50%, d50% is preferably 30 μm or more and 60 μm or less. When d50% is 30 μm or more and 60 μm or less, it will be easy to adjust the initial magnetic permeability at a common range so that an excellent DC superposition characteristic will be provided.

When a section is ground in the soft magnetic metal powder-compact magnetic core mentioned above and then observed, a soft magnetic metal particle preferably faces at least one adjacent particle at a region with no boron nitride present. When at least one grain boundary is lack of boron nitride, the distance between particles will be more minute and can be uniformly formed, leading to a good DC superposition characteristic.

The starting powder is a soft magnetic metal powder having iron as the main component and further contains B. The amount of B in the starting powder is preferably 0.1 mass % or more and 2.0 mass % or less. If the amount of B is less than 0.1 mass %, less boron nitride will be generated after a thermal nitriding treatment and no sufficient boron nitride will be there to fill the void-among-multiple-particles. If the amount of B is over 2.0 mass %, boron nitride which is a non-magnetic component will be excessive and the saturation magnetic flux density will be inconsiderately low.

The water atomizing method, the gas atomizing method or the like can be employed as the method for preparing the starting powder of the soft magnetic metal powder. With the gas atomizing method, particles with a high roundness will be easily obtained. Also, B helps to improve the roundness of the atomized powder, so particles with a high roundness will be provided even if the water atomizing method is used after the atomizing conditions and the like are adjusted.

A thermal nitriding treatment is performed on the starting powder at a non-oxidative atmosphere containing nitrogen at a temperature of 1000 to 1500° C. for 30 to 600 minutes, where the rising rate of temperature is 5° C./min or less. With such a thermal nitriding treatment, nitrogen in the atmosphere reacts with B in the starting powder so that a coating of boron nitride will be uniformly formed on the surface of metal particles. When the temperature is lower than 1000° C. in the thermal treatment, the nitridation of B in the staring powder will not be sufficient. In this case, ferromagnetic phases such as $Fe_2B$ will remain, leading to increased coercivity and loss. If the temperature in the thermal treatment is higher than 1500° C., the nitridation will proceed rapidly to end the reaction so that no effect will be produced even if the temperature rises to a level above that. The thermal nitriding treatment is done at a non-oxidative atmosphere containing nitrogen. The thermal treatment is performed at a non-oxidative atmosphere to prevent the soft magnetic metal powder from oxidizing. If the temperature rises in an unreasonably high rate, the temperature will reach the level where the starting powder particles are sintered before a sufficient amount of boron nitride is generated, resulting in sintering of the starting powder. Thus, the rising rate of temperature is 5° C./min or lower.

The silicone resin is used to cover the soft magnetic metal powder formed with a homogeneous coating of boron nitride so as to provide granular particles. The silicone resin is a resin having a shape-keeping property during molding process and also electrical insulation, and it is preferably a silicone resin that can be uniformly coated on the surface of the soft magnetic metal powder. A solution of silicone resin is added to the soft magnetic metal powder in a specified amount, and then the mixture is mixed in a kneader or the like. The coagulated matter obtained after a drying process is pulverized to provide particles. The obtained soft magnetic metal powder is covered by boron nitride and silicone resin in order.

The obtained particles are filled into a mold having a desired shape and then subjected to a compression molding process to provide a molded article. The pressure during molding can be appropriately selected based on the composition of the soft magnetic metal powder or the desired density and is approximately within the range of 600 to 1600 MPa. A lubricant can also been used if needed. The particle is one obtained by covering a soft magnetic metal powder having a high roundness with homogeneous boron nitride and then the silicone resin. At the initial stage of the compression molding process, the contact plane of the soft magnetic metal powder has a focused stress, so boron nitride peels off at this region. The boron nitride peeled off flows into the void portion in response to the plastic deformation of the soft magnetic metal powder, so it fills the void-among-multiple-particles among soft magnetic metal particles. Here, if the particle has a high roundness, the flow of boron nitride under pressure will not be inhibited so that boron nitride will be uniformly filled in the void-among-multiple-particles. If the silicone resin is contained, the mobility of the silicone resin will help boron nitride flow so that boron nitride is uniformly filled in void-among-multiple-particles. Further, as a coating of boron nitride is uniformly formed after the thermal nitriding treatment, the amount of boron nitride filled in the void-among-multiple-particles is also uniform. As boron nitride is uniformly filled in the void-among-multiple-particles, an effect is produced that the distance between particles of the soft magnetic metal powder can be uniformly kept even the molded article is in a high density. As a result, a good DC superposition characteristic can be provided.

As boron nitride flows in the void-among-multiple-particles and a trace amount of boron nitride is present in the grain boundary, the distance between particles will not be too long, resulting in a decreased magnetic permeability. As such, when boron nitride flows sufficiently in the void-among-multiple-particles during the molding process, a structure comes out that one particle faces at least one adjacent particle at a region where no boron nitride is present. In such a structure, one particle of the soft magnetic metal powder faces at least one adjacent particle, preferably more than half of the particles, at a region with no boron nitride present. In addition, some thin silicone resin is left on the grain boundary of the soft magnetic metal particle where boron nitride peels off, and it functions as an insulating layer to sufficiently inhibit the eddy current loss.

The obtained molded article is subjected to a thermal curing process and then turns to a soft magnetic metal powder-compact magnetic core. Alternatively, in order to eliminate the deformation occurred in the molding process, a thermal treatment is performed to provide a soft magnetic metal powder-compact magnetic core. The thermal treatment is performed at a temperature of 500 to 800° C. preferably at an non-oxidative atmosphere such as nitrogen atmosphere or argon atmosphere. The silicone resin itself is a silicon compound containing Si, O and C. During the thermal treatment, a silicon compound which contains Si, O and C will be provided even if part of the silicone resin is degraded.

As such, a soft magnetic metal powder-compact magnetic core having the structure of the present invention can be obtained.

The preferable embodiment of the present invention has been described above. However, the present invention is not limited to the embodiment above. Various modifications can be made without departing from the spirit and scope of the present invention.

EXAMPLES

As a starting powder, a powder was prepared by a gas atomizing method which was the powder of Fe-3.0Si, Fe-4.5Si and Fe-6.5Si alloy containing B, wherein, B would turn to the desired boron nitride. They were placed in a tubular furnace and then subjected to a thermal nitriding treatment for 30 minutes at a thermal treatment temperature of 1300° C. at a nitrogen atmosphere. Thereby, a soft magnetic metal powder with boron nitride homogeneously formed on the surface was prepared. The d50% of the soft magnetic metal powder was determined by a laser diffraction particle size analyzer (the HELOS system, produced by Sympatec GmbH). The d50%, B content and the preparation method for the starting powder were shown in Table 1.

A silicone resin was diluted with dimethylbenzene and then added to account for 0.5, 0.75 or 1.25 mass % relative to 100 mass % of the soft magnetic metal powder listed in Table 1. The mixture was mixed in a kneader and was dried, and then the obtained coagulated matter was granulated to provide particles of 355 μm or less. In the particles, the soft magnetic metal powder were covered by boron nitride and the silicone resin in order. The particles were filled in a toroidal die with an outer diameter of 17.5 mm and an inner diameter of 11.0 mm and then were applied with a molding pressure of 1180 MPa so as to provide a molded article. The core had a weight of 5 g. A thermal treatment of 30 minutes was applied to the obtained molded article in a conveyer furnace at a temperature of 750° C. at a nitrogen atmosphere so as to provide a soft magnetic metal powder-compact magnetic core (Examples 1-1 to 1-11).

A soft magnetic metal powder-compact magnetic core was prepared similarly as in Examples 1-5 except that the molding pressure was changed to 780 MPa (Comparative Example 1-1). A soft magnetic metal powder-compact magnetic core was prepared similarly as in Examples 1-2 except that the method for preparing the starting powder was replaced with the water atomizing method (Comparative Examples 1-2 and 1-3). A soft magnetic metal powder-compact magnetic core was prepared similarly as in Examples 1-4 except that no silicone resin was added (Comparative Example 1-4).

As a starting powder, Fe-4.5Si alloy powder was prepared by the gas atomizing method. It was placed in a tubular furnace and then subjected to a thermal nitriding treatment for 60 minutes at a temperature of 900° C. at a nitrogen atmosphere so as to prepare a soft magnetic metal powder. The soft magnetic metal powder was subjected to a granulating process, a molding process and a thermal treatment as in Examples 1-1 to 1-11 so as to provide a soft magnetic metal powder-compact magnetic core (Comparative Examples 1-5). In addition, a soft magnetic metal powder-compact magnetic core was prepared similarly as in Comparative Examples 1-4, wherein 1.0 or 1.5 mass % of boron nitride powder was added as a lubricant relative to the particles during the molding process (Comparative Examples 1-6 and 1-7).

A LCR meter (4284A, produced by Agilent Technologies Japan, Ltd.) and a DC bias current power supply (42841A, produced by Agilent Technologies Japan, Ltd.) were used to measure the inductance of the soft magnetic metal powder-compact magnetic core at a frequency of 100 kHz, and the magnetic permeability of the soft magnetic metal powder-compact magnetic core was calculated based on the inductance. The measurement was done when the DC superposition magnetic field was 0 A/m and 8000 A/m, and each magnetic permeability was shown in Table 1 as μ0 or μ(8 kA/m). However, the sample with the highest μ (kA/m) was selected among three samples with the amount of silicone resin changed, and the result was shown.

In addition, the soft magnetic metal powder-compact magnetic core was fixed in a cold mounting and embedding resin and then cut to expose a section which was mirror polished later. The section was randomly observed in one hundred particles. The Wadell roundness was measured in each particle, and then the ratio occupied by particles having a roundness of 0.75 or higher was calculated. In addition, the section of the soft magnetic metal powder-compact magnetic core was observed by an electron microscope and the compositional image was taken. According to the contrast in the image, the ratio of the area occupied by the metal phases to the area of a field of vision was calculated. The results were shown in Table 1.

An electron prober micro-analyzer (EPMA) was used to observe the compositional image and the in-plane distribution of B, N, Si or O at the section of the soft magnetic metal powder-compact magnetic core. The compositional image and the in-plane distribution of B and N at the section of the soft magnetic metal powder-compact magnetic core were observed in several fields of vision. According to the compositional image, the number of the void-among-multiple-particles was calculated. Then, the ratio of the void-among-multiple-particles with boron nitride being present was calculated based on the in-plane distribution of B and N. The results were shown in Table 1.

The soft magnetic metal powder-compact magnetic core was pulverized to prepare particles of 250 μm or less. The amount of B in the powder was determined using an ICP-AES (ICPS-8100CL, produced by SHIMADZU) as the amount of B relative to the soft magnetic metal powder-compact magnetic core. In addition, a device for analyzing nitrogen content (TC600, produced by LECO corporation) was used to measure the nitrogen content in the powder as the amount of N relative to the soft magnetic metal powder-compact magnetic core. The results were shown in Table 1.

TABLE 1

| | Composition | B content in starting powder wt % | Preparation method | d50% μm | Silicone resin | Area ratio % | Ratio occupied by particles having roundness of 0.75 or higher |
|---|---|---|---|---|---|---|---|
| Example 1-1 | Fe4.5Si | 0.30 | Gas | 42 | ○ | 91.4 | 86% |
| Example 1-2 | Fe4.5Si | 0.61 | Gas | 59 | ○ | 90.3 | 86% |
| Example 1-3 | Fe4.5Si | 0.22 | Gas | 32 | ○ | 91.5 | 86% |
| Example 1-4 | Fe4.5Si | 0.75 | Gas | 42 | ○ | 92.5 | 90% |
| Example 1-5 | Fe4.5Si | 0.38 | Gas | 51 | ○ | 91.1 | 90% |
| Example 1-6 | Fe4.5Si | 0.82 | Gas | 42 | ○ | 90.1 | 93% |
| Example 1-7 | Fe4.5Si | 0.95 | Gas | 42 | ○ | 90.0 | 83% |
| Example 1-8 | Fe4.5Si | 0.75 | Gas | 78 | ○ | 91.3 | 93% |
| Example 1-9 | Fe4.5Si | 0.11 | Gas | 21 | ○ | 90.6 | 86% |
| Example 1-10 | Fe3.0Si | 0.30 | Gas | 37 | ○ | 92.1 | 86% |
| Example 1-11 | Fe6.5Si | 0.30 | Gas | 42 | ○ | 90.5 | 86% |
| Comparative Example 1-1 | Fe4.5Si | 0.38 | Gas | 51 | ○ | 85.0 | 92% |
| Comparative Example 1-2 | Fe4.5Si | 0.61 | Water | 42 | ○ | 91.0 | 65% |
| Comparative Example 1-3 | Fe4.5Si | 0.30 | Water | 40 | ○ | 90.5 | 75% |
| Comparative Example 1-4 | Fe4.5Si | 0.75 | Gas | 42 | X | 91.0 | 86% |
| Comparative Example 1-5 | Fe4.5Si | 0.00 | Gas | 39 | ○ | 92.1 | 86% |
| Comparative Example 1-6 | Fe4.5Si | 0.00 | Gas | 42 | ○ | 91.0 | 86% |
| Comparative Example 1-7 | Fe4.5Si | 0.00 | Gas | 38 | ○ | 90.0 | 85% |

| | Ratio of voids-among-multiple-particles with BN present | B content wt % | N content wt % | DC superposition characteristic μ0 | DC superposition characteristic μ (8 kA/m) |
|---|---|---|---|---|---|
| Example 1-1 | 85 | 0.26 | 0.36 | 87 | 48 |
| Example 1-2 | 90 | 0.57 | 0.76 | 56 | 48 |
| Example 1-3 | 80 | 0.17 | 0.24 | 65 | 45 |
| Example 1-4 | 94 | 0.70 | 0.95 | 60 | 45 |
| Example 1-5 | 86 | 0.35 | 0.49 | 83 | 47 |
| Example 1-6 | 95 | 0.78 | 1.08 | 52 | 41 |
| Example 1-7 | 96 | 0.87 | 1.20 | 51 | 41 |
| Example 1-8 | 93 | 0.70 | 0.94 | 85 | 40 |
| Example 1-9 | 71 | 0.09 | 0.13 | 55 | 40 |
| Example 1-10 | 86 | 0.26 | 0.36 | 82 | 43 |
| Example 1-11 | 82 | 0.26 | 0.35 | 82 | 40 |
| Comparative Example 1-1 | 86 | 0.35 | 0.50 | 46 | 35 |
| Comparative Example 1-2 | 90 | 0.57 | 0.77 | 93 | 33 |
| Comparative Example 1-3 | 85 | 0.26 | 0.36 | 86 | 34 |
| Comparative Example 1-4 | 95 | 0.70 | 0.95 | 44 | 28 |
| Comparative Example 1-5 | 0 | 0.00 | 0.00 | 137 | 34 |
| Comparative Example 1-6 | 32 | 0.43 | 0.57 | 87 | 29 |
| Comparative Example 1-7 | 63 | 0.64 | 0.86 | 76 | 33 |

According to Table 1, it can be known that a good DC superposition characteristic was shown in Example 1-1 to 1-11 with μ(8 kA/m) being over 40. Thus, it was confirmed that with the presence of boron nitride and the silicon compound, the ratio of the area occupied by the soft magnetic metal powder to that of the section of the soft magnetic metal powder-compact magnetic core was 90% or more and 95% or less. Further, 80% or more of the particles in the soft magnetic metal powder had a sectional roundness of 0.75 or more and 1.0 or less, and boron nitride was present in 70% or more of the voids-among-multiple-particles among the voids-among-multiple-particles at the section of the soft magnetic metal powder-compact magnetic core. In this way, a good DC superposition characteristic can be provided and the soft magnetic metal powder-compact magnetic core would be excellent.

Figure 3:
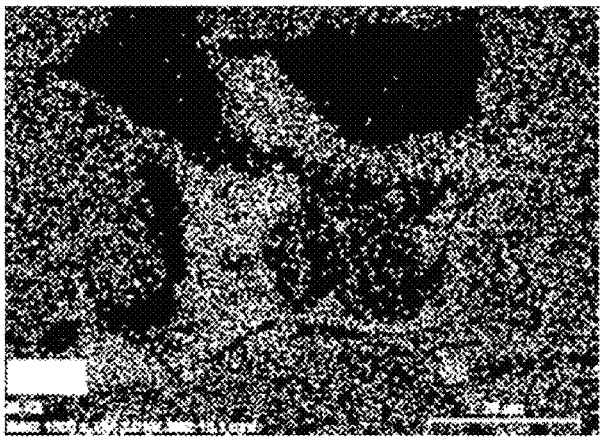
FIG. 3 shows the in-plane concentration distribution of silicon (Si), oxygen (O) and carbon (C) measured by an EDS at the section of a soft magnetic metal powder-compact magnetic core from Example 1-1.
Figure 3:
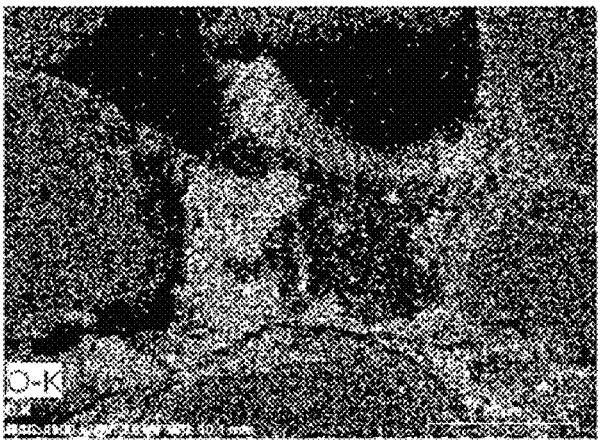
Figure 3:
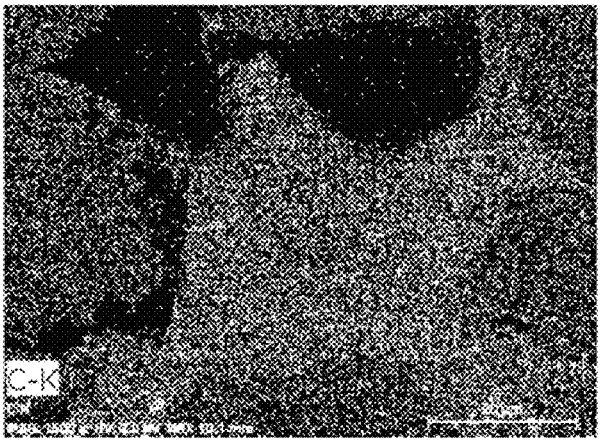

At the polished plane of the section in the soft magnetic metal powder-compact magnetic core from Example 1-1, the part off which the particles peeled was observed using a scanning electron microscope, and the concentration distributions of Si, O and C were determined by an energy dispersive X-ray Spectrometry (EDS). The results were shown in FIG. 3. If the distributions of Si, O and C were compared in parallel, it can be seen that O and C were distributed in a high concentration at the same position where Si was found in a high concentration. Also, it was conformed that the silicon compound containing Si, O and C was distributed at a region with no Fe present, and there was a silicon compound derived from the silicone resin.

Figure 4:
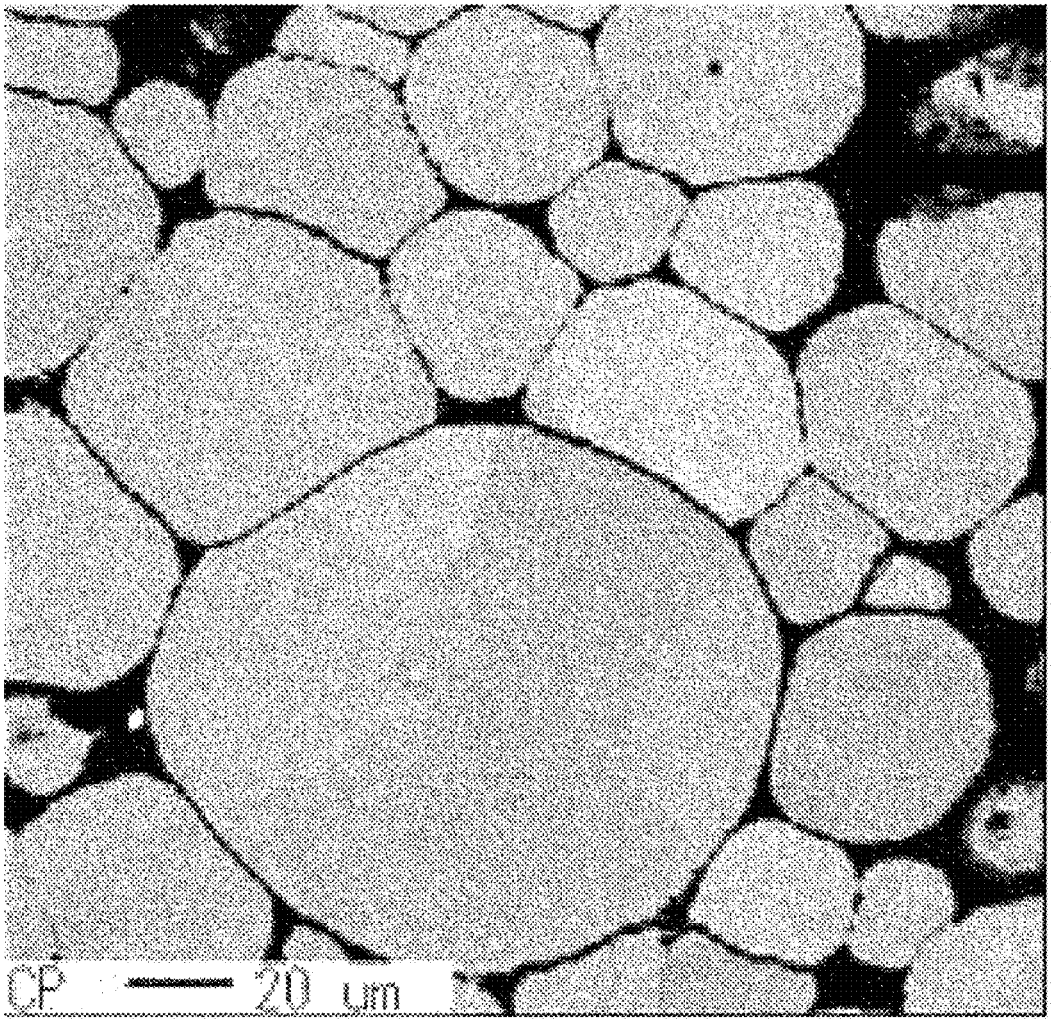
FIG. 4 is a picture showing the compositional image at the section of a soft magnetic metal powder-compact magnetic core from Example 1-1 observed by an electron probe micro-analyzer (EPMA).
Figure 5:
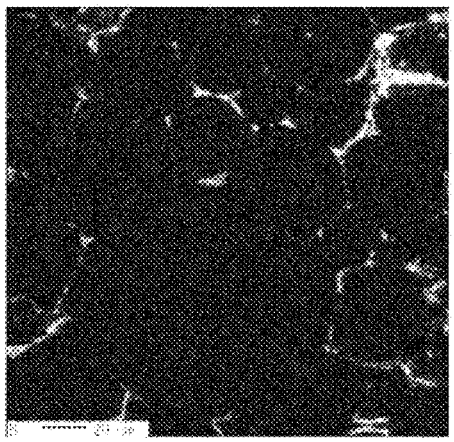
FIG. 5 shows the result of the in-plane concentration distribution of boron (B), nitrogen (N) and silicone (Si) measured by an electron probe micro-analyzer (EPMA) at the section of a soft magnetic metal powder-compact magnetic core from Example 1-1.
Figure 5:
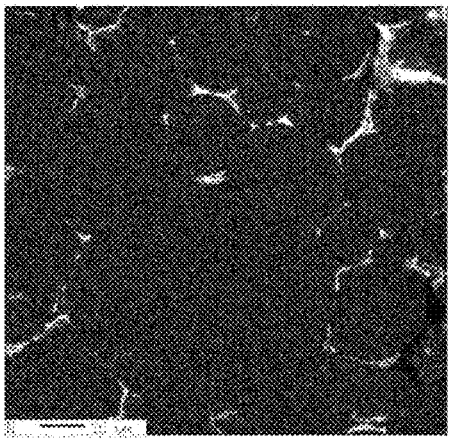
Figure 5:
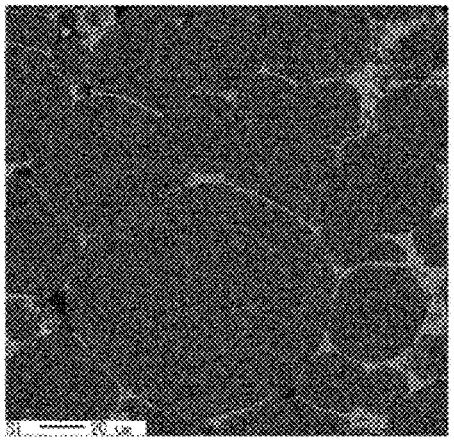

The compositional image observed by an EPMA at the polished plane of the section in the soft magnetic metal powder-compact magnetic core from Example 1-1 was shown in FIG. 4, and the concentration distribution of each element (B, N and Si) was shown in FIG. 5. In FIG. 5, the white part corresponded to a high concentration of each component. If the distribution of void-among-particles observed in the compositional image as shown in FIG. 4 was compared in parallel with the distribution of each element as shown in FIG. 5, it can be known that B and N were concentrated and distributed in the void-among-multiple-particles. Therefore, it was confirmed in Example 1-1 that boron nitride was concentrated in the void-among-multiple-particles. In addition, barely no B or N was detected in the grain boundary of the soft magnetic metal particle, and almost all particles face adjacent particles through the grain boundary containing no boron nitride. That was, a structure was formed that the soft magnetic metal particle faces at least one adjacent particle at a region where no boron nitride was present. On the other hand, it was known about Si that Si from the component of the alloy was detected inside the metal particle and Si was present among metal particles in a higher concentration. It was also known that the Si among metal particles in a high concentration was from the silicone resin, and the silicon compound was uniformly distributed in the grain boundary. Thus, with the structure of boron nitride filling the void-among-multiple-particles, almost no boron nitride was present in the grain boundary so that a structure was provided that the silicon compound was uniformly distributed in the grain boundary. With such a structure, it can be seen that as the magnetization was uniform, a large μ(8 kA/m) was obtained, and the fact that boron nitride was present in 70% or more of the voids-among-multiple-particles among the voids-among-multiple-particles at the section of the soft magnetic metal powder-compact magnetic core was effective in improving the DC superposition characteristic.

Compared to a μ(8 kA/m) of 41 or less in Examples 1-7 and 1-9, an especially good DC superposition characteristic with a μ(8 kA/m) over 45 was provided in Examples 1-1, 1-2, 1-3 and 1-4. In these examples, relative to the soft magnetic metal powder-compact magnetic core, B was 0.17 mass % or more and 0.8 mass % or less, and N was 0.22 mass % or more and 1.00 mass % or less. As such, the distance between particles can be formed in a more uniform manner. Thus, it was preferable that the amount of boron nitride was adjusted to such a range. Especially in Examples 1-1 and 1-2 where B was 0.26 mass % or more and 0.60 mass % or less, and N was 0.34 mass % or more and 0.80 mass % or less, as the amount of boron nitride was within the mentioned range, a good DC superposition characteristic with a μ(8 kA/m) of 48 can be provided.

Compared to a μ(8 kA/m) of 40 in Examples 1-8 and 1-9, an especially good DC superposition characteristic with a μ(8 kA/m) over 45 was provided in Examples 1-2 and 1-3. The d50% was 30 μm or more and 60 μm or less so μ0 can be properly adjusted. Thus, d50% was preferably adjusted to be within such a range.

Figure 6:
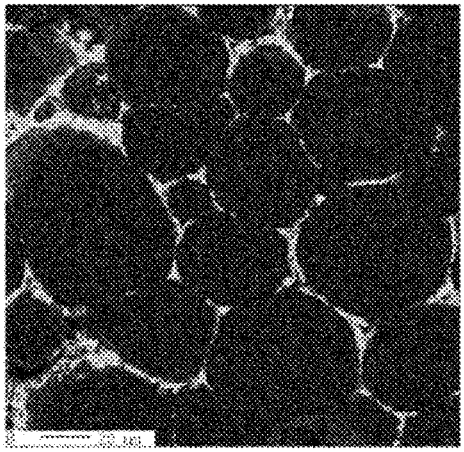
FIG. 6 shows the result of the in-plane concentration distribution of boron (B), nitrogen (N) and silicone (Si) measured by an electron probe micro-analyzer (EPMA) at the section of a soft magnetic metal powder-compact magnetic core from Example 1-7.
Figure 6:
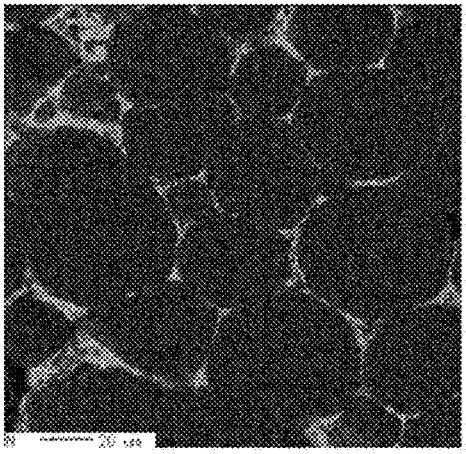
Figure 6:
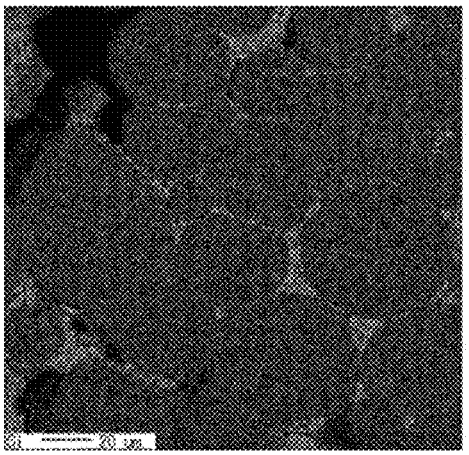
Figure 7:
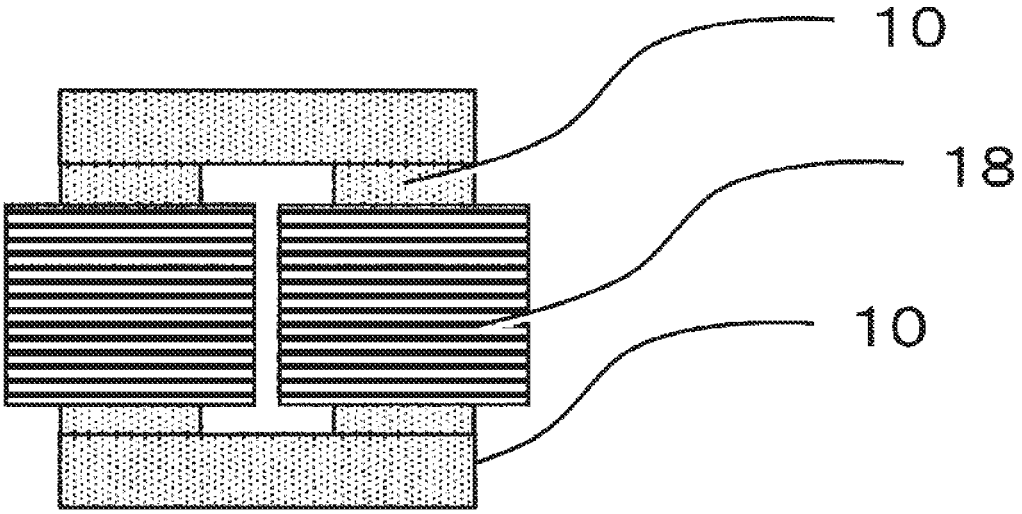
FIG. 7 is a schematic view showing a reactor prepared by using a soft magnetic metal powder-compact magnetic core of the present invention.

Compared to a μ(8 kA/m) of 41 in Example 1-7, an especially good DC superposition characteristic with a μ(8 kA/m) of 48 was provided in Example 1-1. FIG. 6 showed the result obtained by determining using an EPMA the distribution of each element (B, N and Si) on the polished plane of the section in the soft magnetic metal powder-compact magnetic core from Example 1-7. If the distribution of B and N was compared between FIG. 5 and FIG. 6, it can be seen that more metal particles with boron nitride present at the grain boundary with adjacent particles were found in Example 1-7 than in Example 1-1. Thus, the magnetic core having more regions where boron nitride was not present at the grain boundary with adjacent particles was likely to provide a good DC superposition characteristic.

In Comparative Example 1-1, the ratio of the area occupied by the soft magnetic metal powder to that of the section of the soft magnetic metal powder-compact magnetic core was 90% or less and the saturation magnetic flux density of the soft magnetic metal powder-compact magnetic core became much too low, so the DC superposition characteristic deteriorated. As a result, only a low magnetic permeability μ(8 kA/m) less than 40 was obtained. It can be known from Example 1-1 to Example 1-11 that the ratio of the area occupied by the soft magnetic metal powder to that of the section of the soft magnetic metal powder-compact magnetic core was 90% or more, so the μ(8 kA/m) was over 40. Thus, the ratio of the area occupied by the soft magnetic metal powder to that of the section of the soft magnetic metal powder-compact magnetic core was necessarily to be 90% or more.

In Comparative Examples 1-2 and 1-3, the ratio occupied by the particles having a roundness of 0.75 or more was less than 80%. In Comparative Examples 1-2 and 1-3, too many particles with a low roundness were there, so μ0 was much too high. As a result, only a low magnetic permeability μ(8 kA/m) less than 40 was obtained. In Example 1-1 to Example 1-11, the ratio occupied by the particles having a roundness of 0.75 or more was 80% or more, so μ(8 kA/m) was higher than 40. In this respect, the ratio occupied by the particles having a roundness of 0.75 or more was necessarily to be 80% or more.

In Comparative Example 1-4, no silicone resin was contained, so no silicon compound was present among particles of the soft magnetic metal powder, leading to a deteriorated electrical insulation. Thus, the eddy current was evidently generated so that the magnetic permeability at 100 kHz decreased. In addition, as no effect had been produced by the silicone resin to promote boron nitride to flow to the void-among-multiple-particles, the grain boundary region with boron nitride present became more and the distance between particles became non-uniform. Thus, the μ0 became smaller and the DC superposition characteristic deteriorated, so only a low magnetic permeability μ(8 kA/m) less than 40 was obtained. It was known from Example 1-1 to 1-11 that μ(8 kA/m) was higher than 40 as the silicone compound was present. Thus, it was necessary to contain the silicon compound.

In Comparative Example 1-5, no boron nitride was present at the void-among-multiple-particles at the section of the soft magnetic metal powder-compact magnetic core. In addition, as in Comparative Examples 1-6 and 1-7, as boron nitride was not uniformly distributed before the molding process even if a boron nitride powder was added during the compression molding process as the lubricant, boron nitride was only present in 35% and 63% of the voids-among-multiple-particles. The soft magnetic metal powder around the void-among-multiple-particles having no boron nitride attached to each other closely since no boron nitride functioned here as a wedge to keep the distance between particles. Thus, at these regions, the distance between particles became much too short and the magnetization was not uniform. In this respect, only a low magnetic permeability μ(8 kA/m) less than 40 was obtained. It can be known from Examples 1-1 to 1-11 that μ(8 kA/m) was over 40 as boron nitride was present in 70% or more of the voids-among-multiple-particles. Boron nitride was necessarily present in 70% or more of the voids-among-multiple-particles.

INDUSTRIAL APPLICATION

As mentioned above, the soft magnetic metal powder-compact magnetic core of the present invention can be made to be highly efficient in a small size because it had decreased loss and a high inductance even at a condition of DC superposition. Thus, the soft magnetic metal powder-compact magnetic core of the present invention can be widely and effectively used in an inductor such as a power circuit and alternatively an electromagnetic device such as a reactor.

DESCRIPTION OF REFERENCE NUMERALS

10 Soft magnetic metal powder-compact magnetic core
11 Soft magnetic metal powder
12 Silicon compound
13 Boron nitride
14 Void-among-multiple-particles surrounded by 4 particles
15 Void-among-multiple-particles surrounded by 3 particles
16 Void surround by 2 particles
17 Grain boundary
18 Coil

What is claimed is:

1. A soft magnetic metal powder-compact magnetic core, comprising a soft magnetic metal powder, boron nitride and a silicon compound, wherein, when a section of the soft magnetic metal powder-compact magnetic core is ground and then observed, a ratio of an area occupied by the soft magnetic metal powder to that of the section of the soft magnetic metal powder-compact magnetic core is 90% or more and 95% or less, and a roundness in the section of 80% or more of particles constituting the soft magnetic metal powder is 0.75 or more and 1.0 or less, and boron nitride exists in 70% or more of voids-among-multiple-particles in the section of the soft magnetic metal powder-compact magnetic core.

2. The soft magnetic metal powder-compact magnetic core of claim 1, wherein, the silicon compound is derived from silicone resin and comprises silicon (Si), oxygen (O) and carbon (C).

3. The soft magnetic metal powder-compact magnetic core of claim 1, wherein, 0.17 mass % or more and 0.80 mass % or less of boron (B) and 0.22 mass % or more and 1.00 mass % or less of nitrogen (N) are contained in the soft magnetic metal powder-compact magnetic core.

4. The soft magnetic metal powder-compact magnetic core of claim 1, wherein, in a particle size distribution of the soft magnetic metal powder, when a particle diameter at which a number cumulated from a small side reaches 50% is defined as d50%, d50% is 30 μm or more and 60 μm or less.

5. The soft magnetic metal powder-compact magnetic core of claim 1, wherein, when the section of the soft magnetic metal powder-compact magnetic core is ground and then observed, it has a structure that one of the particles constituting the soft magnetic metal powder faces at least one adjacent particle at a region where no boron nitride exists.

6. A reactor prepared by using the soft magnetic metal powder-compact magnetic core of claim 1.

* * * * *